United States Patent [19]
Rohrer
[11] 4,199,075
[45] Apr. 22, 1980

[54] HINGE STRUCTURE FOR REFUSE CONTAINERS

[75] Inventor: John D. Rohrer, Silver Lake, Ind.
[73] Assignee: Parker Industries, Inc., Silver Lake, Ind.

[21] Appl. No.: 932,031
[22] Filed: Aug. 8, 1978
[51] Int. Cl.² ..... E05F 1/12; B65D 43/16
[52] U.S. Cl. ..... 220/334; 16/180; 220/1 T
[58] Field of Search ..... 16/180, 182, 183, 129, 16/186; 220/334, 335, 336, 337, 342, 343, 1 T

[56] References Cited

U.S. PATENT DOCUMENTS

| | | | |
|---|---|---|---|
| 2,602,957 | 7/1952 | Anderson | 16/180 X |
| 2,904,853 | 9/1959 | Devery | 16/180 X |
| 3,061,871 | 11/1962 | Swanson | 16/180 |
| 3,136,575 | 6/1964 | Kolling | 220/343 X |
| 3,476,375 | 11/1969 | Brasseur | 16/180 X |
| 3,955,241 | 5/1976 | Little | 16/180 |
| 4,119,195 | 10/1978 | Widener | 220/343 X |
| 4,133,074 | 1/1979 | Schack | 16/180 |

*Primary Examiner*—C. J. Husar
*Assistant Examiner*—Mosha I. Cohen
*Attorney, Agent, or Firm*—Marmaduke A. Hobbs

[57] ABSTRACT

A hinge structure for refuse containers having a body and a top opening and a lid for the opening, in which the lid is attached to the body by a hinge structure having a torque bar therein for assisting in the opening of the lid. The torque bar runs along the back of the lid and has laterally extending ends which engage abutments on the body to apply torque to cause the bar to exert a lifting force to the lid. The ends disengage the abutments after the lid has been opened to a predetermined point so that the lid can be easily and fully opened without the torque bar interfering with the full opening of the lid. The lid can be easily lifted to empty refuse into the container and will fully reclose itself notwithstanding the restraining effect of the torque bar.

10 Claims, 6 Drawing Figures

Fig. 3
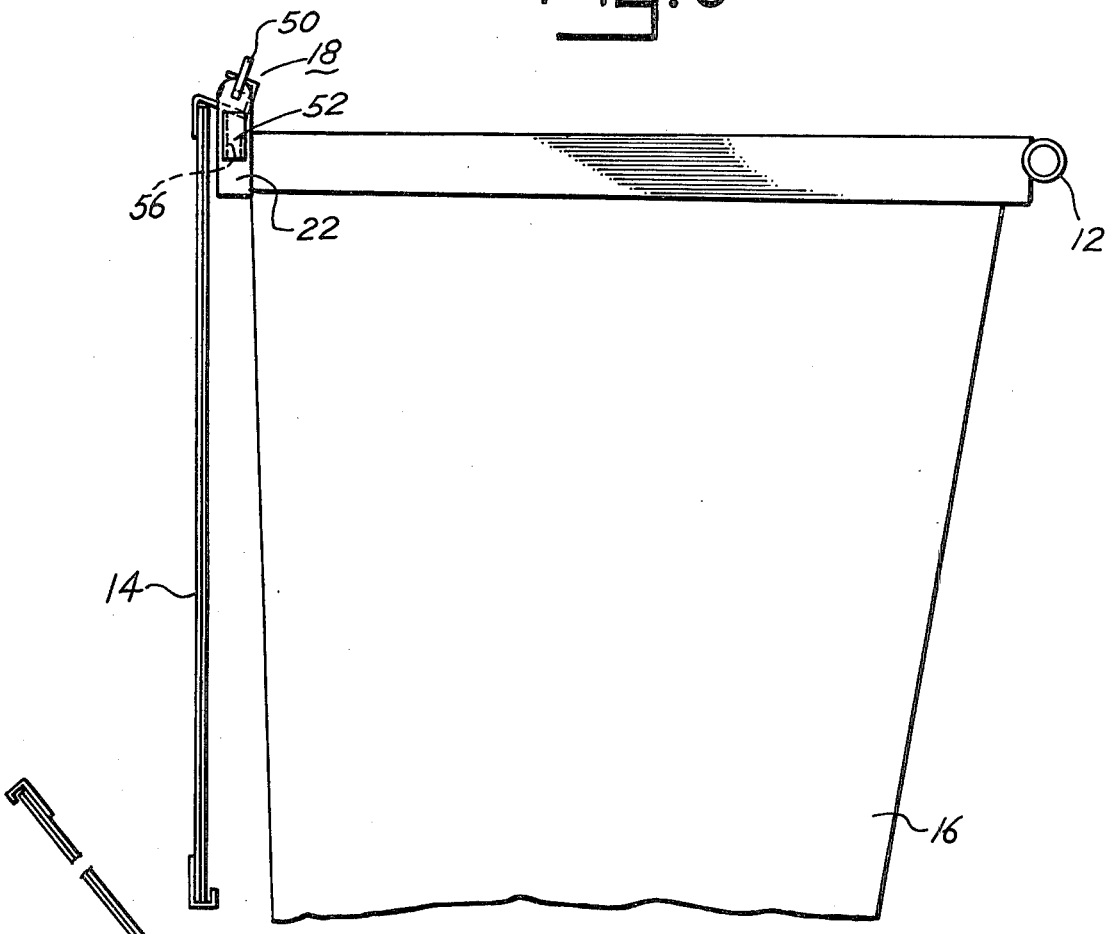
Fig. 4
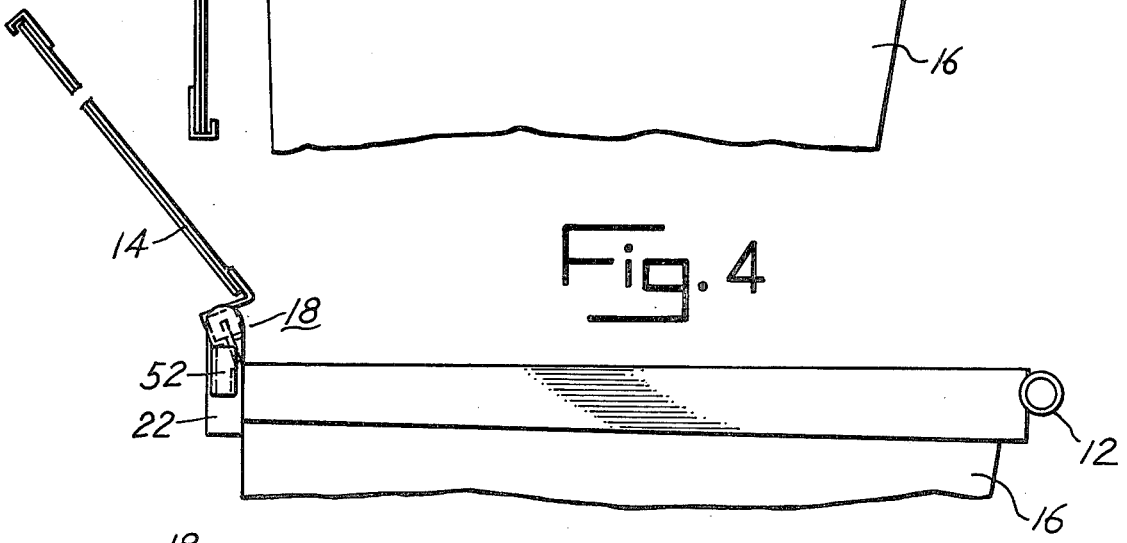
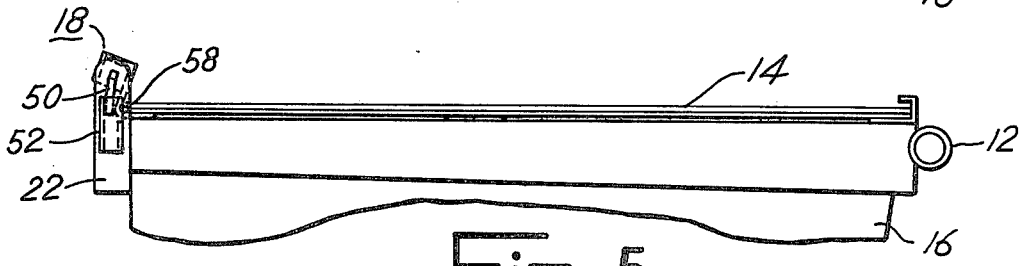
Fig. 5

HINGE STRUCTURE FOR REFUSE CONTAINERS

A refuse container commonly used in industrial plants, businesses and institutions, and by apartments and hotels and similar commercial enterprises, consists of a generally rectangular container body of steel plate construction, and a plate-like steel lid hinged to an upper rear edge of the body. The container is relatively large and heavy and is left at the establishment for accumulation of refuse, and is emptied from time to time by a refuse truck using a mechanical power lift which elevates and inverts the container to dump the contents therefrom into the truck. In view of the large capacity of these refuse containers, they are made sturdy, and the lid is heavy and often difficult and possibly unsafe for one person to open when refuse is to be dumped into the container and thereafter when the contents are to be dumped into the truck. It is therefore one of the principal objects of the present invention to provide a mechanism for use with the lid of a refuse container which will assist in lifting the lid to its opened position, and which is compact and simple in construction and can effectively be installed on the standard or conventional refuse containers of the aforesaid type without making any substantial changes in the construction of the container.

Another object of the present invention is to provide a refuse container having a plate-like lid hinged to an uppeer edge of the container body, in which a mechanism for assisting in raising the lid is incorporated in the hinge structure and forms a part of the pivot mechanism of the hinge, and which can be opened to its fully opened position without interference from the assist mechanism for dumping the contents from the container.

Still another object is to provide a hinge structure for the lid of the aforementioned type of refuse container which employs one or more torque bars forming the pivot pin of the hinge, and which is so designed and constructed that the hinge structure is mostly enclosed by the margin of the lid and hence is protected from dirt and weather to give long trouble free service.

A further object of the invention is to provide a refuse container of the type designed and built to be emptied by a power mechanism on a refuse pick-up truck, the lid of which can be easily opened and safely used by one person when dumping refuse into the container, and which provides maximum safety to other persons using or otherwise handling or being around the container.

Additional objects and advantages of the present invention will become apparent from the following description and accompanying drawings, wherein:

FIG. 3 is a side elevational view of the refuse container shown in FIG. 1 with the lid thereof in fully opened position;

FIG. 4 is a fragmentary side elevational view of the refuse container showing the lid in a partially opened position;

FIG. 5 is a fragmentary side elevational view of the refuse container showing the lid in its fully closed position.

Figure 1:
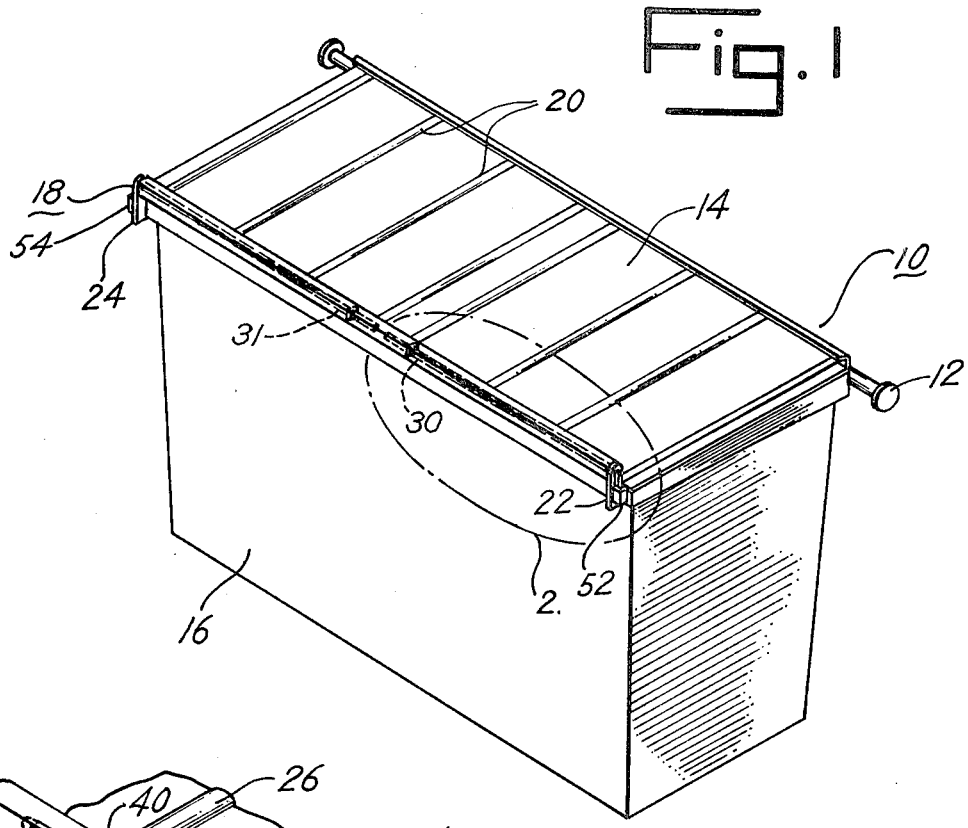
FIG. 1 is a perspective view of a refuse container embodying the present invention.

Referring more specifically to the drawings, FIG. 1 designates a refuse container of the type normally used for large commercial and industrial establishments, apartment houses, dormitories and the like, and which is emptied by a refuse truck which lifts and inverts the container to dump the contents thereof into the truck bed. The container, as shown, includes a pick-up arm 12 at each end for engagement by the lift mechanism of the truck when the container is to be emptied. The container may be mounted on casters (not shown) and may include a lid 14 connected to body 16 by a hinge structure 18. The body and the lid are constructed of heavy sheet metal to form a generally rectangular container structure. The containers may be of different sizes; however, the structures are similar in cnstruction and operation. The lid, which is relatively heavy, normally contains one or more handles along the front or side edges and, in order to provide the required sturdiness and durability, it is constructed of relatively thick sheet or plate metal and, in the embodiment shown, contains a plurality of ribs 20. In view of the thickness and size of the lid structure, it is heavy and difficult to open, particularly since it is relatively large and cannot be easily handled.

The primary feature of the present invention is the hinge and lid assist structure, indicated generally by numeral 18, which is disposed along the upper edge of the back of the body 16 and includes upright fixtures 22 and 24 at the opposite ends of the upper edge of the body, the two fixtures being rigidly secured by welding or other suitable connecting means to the body. The cover 14 is pivotally connected to the two fixtures by torque bars 30 and 31 extending parallel to the rear edge of the lid and being pivotally connected thereto by blocks 32 at each end. The two blocks 32 are secured to the cover by an inverted U-shaped flange 34, preferably formed integrally with the rear edge of the cover, and the blocks 32 are welded or otherwise secured in the respective ends of channel 36 of the U-shaped flange. The two blocks contain openings for bars 30 and 31 and the lid can rotate relative to the bars at the opposite ends, so that the lid will pivot to its fully closed position shown in FIG. 5. Thus the lid is hinged to the body and can be swung from its closed position to its fully opened position when refuse is to be removed from the container. In normal use, the lid is raised only to a partially opened position for the purpose of dumping refuse into the container.

Figure 2:
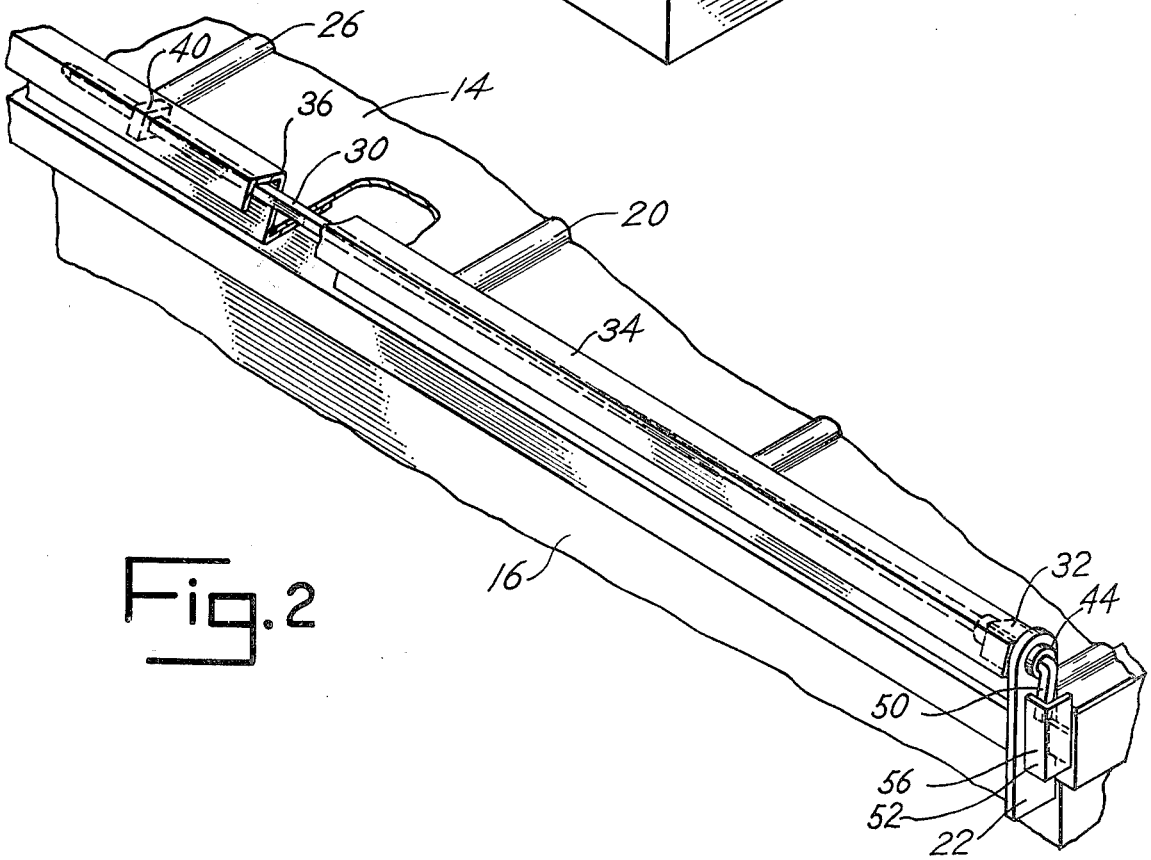
FIG. 2 is an enlarged fragmentary perspective view of the hinge and lid assist structure shown in FIG. 1, the portion shown being identified in FIG. 1 by the broken line circle.
Figure 6:
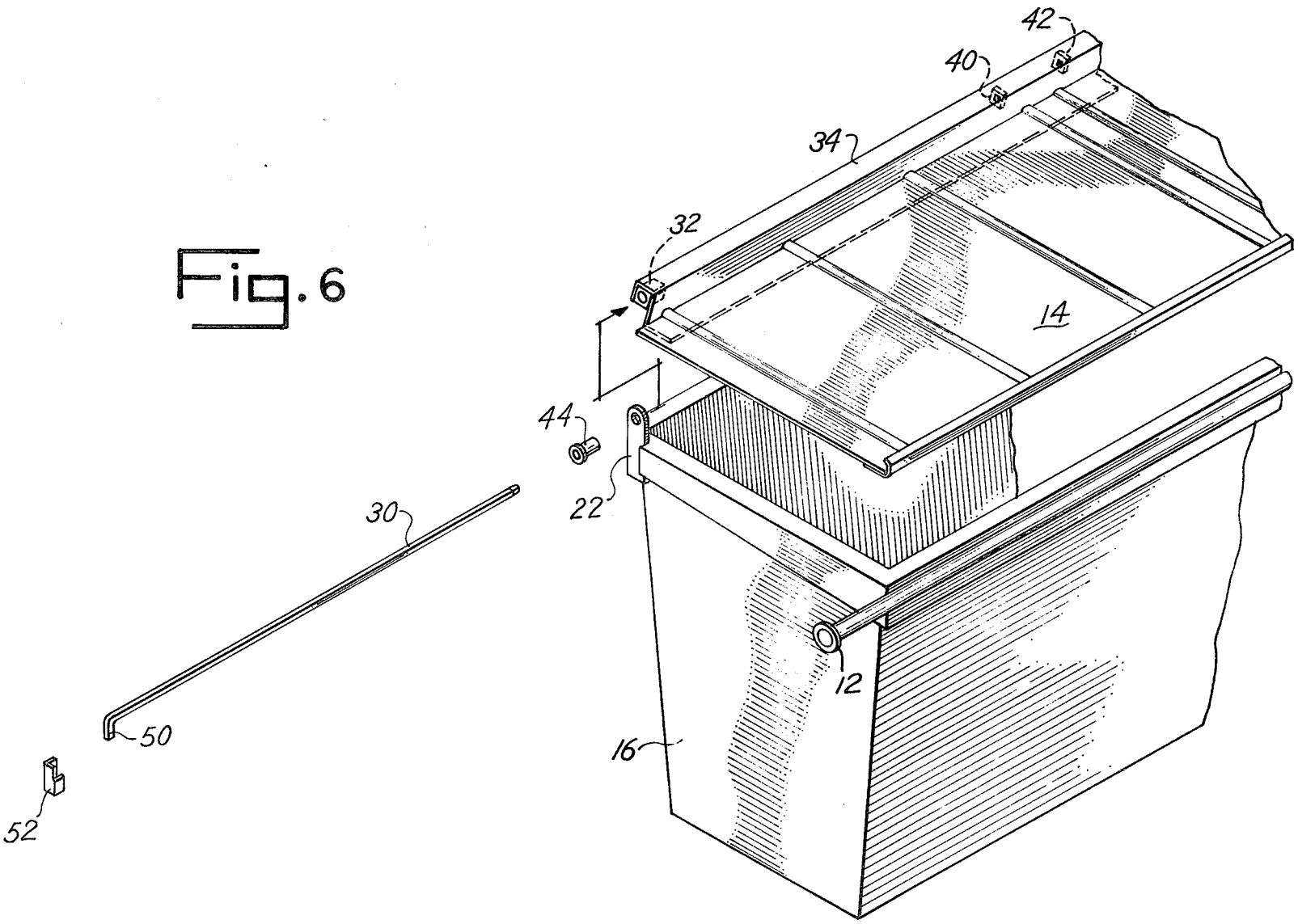
FIG. 6 is an exploded perspective view of a portion of the refuse container and hinge and lid assist structure.

The torque bars 30 and 31 are square in cross section and the inner ends seats in blocks 40 and 42 mounted in U-shaped flange 34 and held therein from rotating by the square configuration of the blocks, which fit sufficiently close to the walls of the flange to prevent rotation of the blocks within the flange. Since blocks 40 and 42, which are disposed near the lengthwise center of the flange, are non-rotatable, and the holes through the blocks are of a square cross section substantially the same size as the dimension of bars 30 and 31, the movement of the lid between opened and closed positions rotates the bars. The outer end of each end of the bars passes through a sleeve 44 in fixtures 22 and 24, and extends downwardly at right angles, as seen in FIG. 2, to form a finger 50. The lower end of each finger seats in the respective brackets 52 and 54 at the right and left hand ends of the refuse container as viewed in FIG. 1, the brackets forming a stop or abutment for the fingers.

When the lid is moved toward closed position, the fingers 50 engage the rear wall 56 of the brackets and hence prevent the bars from rotating further with the lid. Further movement of the lid twists the bars, thereby restraining the closing movement of the lid. When the lid is opened, the resilient force contained in the torque bars assists in lifting the lid so that substantially less force is required to raise the lid to an elevated position than is normally required with the lid of a conventional refuse container. If desired the torque bars may be connected at their inner ends to form a continuous bar along the rear of the lid.

When the lid is opened to the fully opened position as seen in FIG. 3, interference by the torque bars is avoided by permitting movement of fingers 50 away from the rear wall 56 as the lid is moved past a predetermined opened position. As the fingers swing away from the rear wall of the brackets, they pass through the forward opened side 58 of the brackets and rotate as the lid is opened further, thus applying no further torque or assistance to the lid as the lid is moved from the predetermined position to its fully opened position. As the lid is closed and the predetermined position of the lid is reached in the closing direction, the fingers 50 at the opposite ends of the lid engage rear wall 56 of bracket 52 and apply increasing resistance or restraining force to the closing movement of the lid, the force, however, being insufficient to prevent fully closing the lid.

In the operation of the present refuse container and lid structure, with the lid 14 assembled on body 16 in the manner illustrated in FIGS. 1 and 2, and with the lid closed, fingers 50 engage wall 56 of brackets 52 and 54 at the opposite ends of the rear side of the lid. Since the fingers engage the wall before the lid is fully closed, the torque bars 30 and 31 are twisted sufficiently to resiliently resist the closing of the lid. When the lid is to be opened, the forward edge is raised and the lifting is assisted by the resilient force contained in the twisted torque bars, the lid being assisted to the point where fingers 50 no longer contact rear wall 56. Thereafter, if the lid is opened further, the fingers swing forwardly and will pass the front wall of brackets 52 and 54 permitting the lid to move to its fully opened position as illustrated in FIG. 3 without interference from fingers 50 or the torque bars. The refuse container can now be easily emptied by a refuse truck lifting and inverting the container. After the emptied container has been returned to its upright position, the lid is then rotated on the hinge formed in part by the torque bars to its fully closed position. As the lid is moved from a predetermined point in the closing direction, the fingers engage the rear wall 56 and again apply a twisting action to each end section of the torque bar assembly.

It is thus seen that the present refuse container lid and hinge concept forms a hinge structure having a compact resilient lift assist mechanism incorporated therein. The lid assist structure is essentially enclosed except for the two fingers 50, and no dangerous elements such as springs and levers, which could injure someone handling the container, are exposed. Further, the assist prevents the lid, which is relatively heavy, from falling unrestrained to its closed position where it could cause serious injury to someone closing the container or opening the container to empty refuse therein.

While only one embodiment of the present refuse container lid structure has been described in detail herein, various changes and modifications may be made without departing from the scope of the invention.

I claim:

1. A hinge structure for refuse containers having a body with a top opening and a lid for the opening: said hinge structure comprising a fixture disposed at each end at the upper rear corners of the body and having a hole therethrough, a torque bar means extending along the rear side of the lid and extending through the holes in said fixtures, finger means attached to each end of the torque bar means and extending substantially at right angles thereto, spaced pivot means attached to said lid near said fixtures and being rotatable on said bar means as said lid is opened and closed, means disposed between said spaced pivot means for preventing relative rotation between the lid and said bar means in a section spaced from said pivot means, an abutment on said body at each end of said bar means forming a stop for said fingers to limit the rotation of the end sections of said bar means and thereby causing said bar means to apply a force tending to open said lid, said abutments being mounted rigidly on said body adjacent the rear edge thereof and so disposed relative to said fingers that said fingers move away from said abutments when the lid is partially opened, such that said bar means assists only the initial opening of the lid and resists only the final closing of said lid.

2. A hinge structure for refuse containers as defined in claim 1 in which said lid has a U-shaped flange along the rear edge thereof and said torque bar means is disposed in said flange.

3. A hinge structure for refuse containers as defined in claim 2 in which said spaced pivot means attached to said lid consists of blocks disposed at each end of said U-shaped flange and containing holes for said bar means.

4. A hinge structure for refuse containers as defined in claim 3 in which said means disposed between said spaced pivot means consists of a block-like means near the center of said bar means within said U-shaped flange, said flange holding said block from rotating relative to said lid.

5. A hinge structure for refuse containers as defined in claim 4 in which said torque bar means consists of longitudinal sections and is square in cross section and said fingers are attached integrally to the ends of said bar sections.

6. A hinge structure for refuse containers as defined in claim 1 in which said torque bar means consists of two longitudinal sections and is square in cross section and said fingers are attached integrally to the ends of said bar sections.

7. A hinge structure for refuse containers having a body with a top opening and a lid for the opening: said hinge structure comprising a fixture disposed at each end of the upper rear corners of the body and being pivotally connected to the lid, a torque bar attached to said lid in spaced relation to one of said fixtures, a radially extending means adjacent said one fixture, an abutment engageable by said radially extending means on the body for limiting the rotational movement of the end of said torque bar near said one fixture only as said lid is moved toward closed position to cause said bar to assist only the initial opening of said lid and to resist only the final closing of said lid.

8. A hinge structure for refuse containers as defined in claim 7 in which a flange is attached to the rear edge of said lid and substantially encloses said torque bar.

9. A hinge structure for refuse containers as defined in claim 7 in which said means is a finger rigidly attached to the end of said bar adjacent one of said fixtures, and said abutment is so disposed relative to said finger that said finger moves away from said abutment when the lid is partially opened.

10. A hinge structure for refuse containers as defined in claim 9 in which a flange is attached to the rear edge of said lid and substantially encloses said torque bar.

* * * * *